US005580642A

United States Patent [19]

Okamoto et al.

[11] Patent Number: 5,580,642

[45] Date of Patent: Dec. 3, 1996

[54] REINFORCING MEMBER FOR CIVIL AND ARCHITECTURAL STRUCTURES

[75] Inventors: Tadashi Okamoto, Tokyo; Sumiyuki Matsubara, Nagareyama, both of Japan

[73] Assignee: Mitsui Kensetsu Kabushiki Kaisha, Tokyo, Japan

[21] Appl. No.: 261,013

[22] Filed: Jun. 14, 1994

Related U.S. Application Data

[63] Continuation of Ser. No. 29,407, Mar. 10, 1993, abandoned.

[30] Foreign Application Priority Data

Mar. 25, 1992 [JP] Japan ..... 4-067563

[51] Int. Cl.[6] ..... B32B 3/00; E04C 5/07

[52] U.S. Cl. ..... 428/212; 428/222; 428/257; 428/297; 428/367; 428/369; 428/371; 428/377; 52/223.1; 52/223.4; 52/223.8; 52/223.14; 52/309.13; 52/740.1

[58] Field of Search ..... 428/34.5, 36.3, 428/113, 212, 222, 257, 297, 364, 365, 367, 369, 371, 377, 374, 397; 52/223.1, 223.4, 223.8, 223.14, 231, 309.13, 719, 740.1, 740.8, 740.9

[56] References Cited

U.S. PATENT DOCUMENTS

| | | | |
|---|---|---|---|
| 3,291,897 | 12/1966 | Bramley | 174/126 |
| 4,144,115 | 3/1979 | Sundberg | 156/161 |
| 4,275,117 | 6/1981 | Crandall | 428/373 |
| 4,371,180 | 2/1983 | Case et al. | 277/230 |
| 4,376,675 | 3/1983 | Perrotta | 162/145 |
| 4,430,851 | 2/1984 | Sundet | 57/211 |
| 4,590,025 | 5/1986 | Reiter et al. | 264/103 |
| 4,684,567 | 8/1987 | Okamoto et al. | 428/257 |
| 4,786,341 | 11/1988 | Kobatake et al. . | |
| 4,876,143 | 10/1989 | Sugita et al. | 428/294 |
| 4,948,661 | 8/1990 | Smith et al. | 428/286 |
| 4,976,812 | 12/1990 | McConnell et al. | 156/148 |
| 5,082,701 | 1/1992 | Craven et al. | 428/34.5 |
| 5,176,868 | 1/1993 | Davis | 264/257 |
| 5,290,230 | 3/1994 | Ainsworth et al. | 604/96 |
| 5,326,410 | 7/1994 | Boyles | 156/71 |
| 5,389,411 | 2/1995 | Cohen | 428/34.6 |
| 5,429,863 | 7/1995 | McMillin | 428/224 |
| 5,437,899 | 8/1995 | Quigley | 428/35.7 |

FOREIGN PATENT DOCUMENTS

| | | |
|---|---|---|
| 53-159115 | 12/1978 | Japan . |
| 60-119853 | 6/1985 | Japan . |
| 61-290150 | 12/1986 | Japan . |
| 62-7655 | 1/1987 | Japan . |
| 62-133223 | 6/1987 | Japan . |
| 62-244980 | 10/1987 | Japan . |
| 62-288248 | 12/1987 | Japan . |
| 3-212568 | 9/1991 | Japan . |

OTHER PUBLICATIONS

"Maintenance of Bridges", Published Oct. 1, 1974, T. Kensetsu–(Abstract Included).

Excerpt from Seminar held in Sep. 1978, Sponsored by Japan Architecture Association.

"Improvement of Shear Capacity of Existing Reinforced Concrete Members with Sheet Type Carbon Fiber Reinforcement" *Concrete Reasearch and Technology*, vol. 3, No. 2, Jul., 1992.

*Primary Examiner*—Patrick Ryan
*Assistant Examiner*—Marie R. Yamnitzky
*Attorney, Agent, or Firm*—Armstrong, Westerman, Hattori, McLeland & Naughton

[57] ABSTRACT

A reinforcing member for civil and architectural structures is made up of a mixture of reinforcing fibers and thermoplastic fibers which become thermoplastic at a temperature which is lower than a temperature at which the reinforcing fibers become thermoplastic. The thermoplastic fibers may be mixed into each bundle of the reinforcing fibers. The mixture may be formed by arranging respective fiber bundles of the reinforcing fibers and fiber bundles of the thermoplastic fibers. It may also be made by mixing the thermoplastic fibers and an electrically conductive heat-generating wiring material into the reinforcing fibers.

17 Claims, 3 Drawing Sheets

REINFORCING MEMBER FOR CIVIL AND ARCHITECTURAL STRUCTURES

This application is a continuation of application Ser. No. 08/029,407 filed Mar. 10, 1993, now abandoned.

BACKGROUND OF THE INVENTION

This invention relates to such a reinforcing member for civil and architectural structures as is used for reinforcing beams and columns of a building, and structures such as piers of a bridge, chimneys, or the like.

Conventionally, it is normal practice, in reinforcing existing civil and architectural structures such as columns and beams of a building, a chimney, or the like, to wind reinforcing bars or wires around the portions to be reinforced and, thereafter, to coat their surfaces with mortar or paint for corrosion prevention of the reinforcing bars or the wires.

The applicants of this application previously proposed in Japanese Published Unexamined Patent Application No. 290150/1986, Japanese Published Unexamined Patent Application No. 7655/1987 and U.S. Pat. No. 4,684,567 the following reinforcing member for civil and architectural structures in order to improve the disadvantages of the reinforcing bars and wires to be used in the civil and architectural structures in that they are easily subject to corrosion and are heavy. Namely, the proposed reinforcing member is made up by forming into braided cords or ropes chemical or man-made fibers having a relatively large tensile strength such as carbon fibers, glass fibers, aromatic polyamide fibers or the like, and then hardening them by impregnating them with a thermoplastic resin.

However, the method of reinforcing by winding the above-described reinforcing bars or the like around the portion to be reinforced has the following disadvantages. Namely, it is not economical in that the coating work for corrosion prevention is time-consuming and expensive. In addition, since the lifetime of the coating is short, it becomes necessary to perform repairs again at a later date and, consequently, the structures are more likely to be damaged, than leaving them unrepaired, by the increase in weight in the repaired portion due to the weight of the added reinforcing bars or wires.

Further, it was once considered to be advantageous to use the reinforcing members made up of the above-described chemical fibers in minimizing the increase in weight of the repaired structures. However, since the reinforcing member is in the form of a bar which is hardened by impregnation of a resin, it has been found difficult to wind it around the structures, such as columns, to be repaired.

SUMMARY AND OBJECT OF THE INVENTION

This invention has an object of providing such a reinforcing member for civil and architectural structures as will not require coating for corrosion prevention and is small in increase in weight. This invention has still another object of providing a reinforcing member which can be easily wound around the portion to be repaired and which does not require repeated repairs.

In order to attain the above objects, this invention provides a reinforcing member for civil and architectural structures, the reinforcing member being constituted by braiding bundles of reinforcing fibers into a braided fiber body, wherein the braided fiber body is made up of a mixture of the reinforcing fibers and thermoplastic fibers the thermoplastic fibers being meltable at a temperature which is lower than a temperature at which the reinforcing fibers are meltable.

According to a second aspect of this invention, the mixture is formed into a braided fiber body by mixing thermoplastic fibers into each bundle of the reinforcing fibers.

According to a third aspect of this invention, the mixture is formed into a braided fiber body by arranging respective fiber bundles of the reinforcing fibers and fiber bundles of the thermoplastic fibers.

According to a fourth aspect of this invention, the mixture is formed into a braided fiber body by mixing the thermoplastic fibers and an electrically conductive heat-generating wiring material into each bundle of the reinforcing fibers.

According to a fifth aspect of this invention, the mixture is formed into a braided fiber body by arranging respective fiber bundles of the reinforcing fibers and fiber bundles of the thermoplastic fibers which is mixed with an electrically conductive heat-generating wiring material.

According to a sixth aspect of this invention, the braided fiber body is arranged into a hollow braid having a hollow portion in the center thereof and an electrically conductive heat-generating wiring material is inserted into the hollow portion.

When a column, for example, of a structure is reinforced, since the above-described reinforcing member is constituted or constructed by bundles of fibers, it is relatively soft and has a good flexibility. It can therefore be easily wound around the column. After having wound it around the column, both ends of the reinforcing member are fixed to the column. Thereafter, when the heat is applied to the reinforcing member by means of an appropriate heating device or through electric supply to the electrically conductive heat-generating wiring material which is mixed into the braided fiber body, the thermoplastic fibers mixed into the braided fiber body become molten and are impregnated or penetrated into or among the reinforcing fibers. If they are left as they are, they will then be hardened in a condition of being wound around the column, resulting in a stable condition in which the reinforcing member is not displaced or removed in position. The hardened reinforcing member performs the same function as that of the reinforcing bars which are wound around the column. In case there occurs in the column a force of expansion in the radial direction, the force is supported by the reinforcing fibers of larger tensile strength to thereby prevent the column from deforming in the radial direction.

BRIEF DESCRIPTION OF THE DRAWINGS

The above and other objects and the attendant advantages will become readily apparent by reference to the following detailed description when considered in conjunction with the accompanied drawings wherein.

DETAILED DESCRIPTION OF PREFERRED EMBODIMENTS

Figure 1:
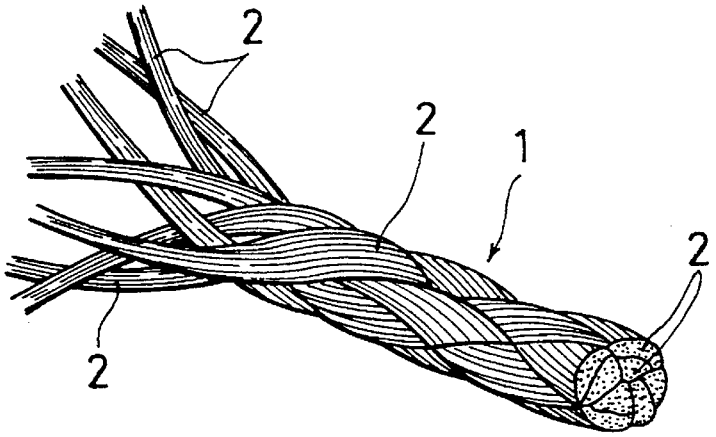
FIG. 1 is a perspective view of a first embodiment of a reinforcing member for civil and architectural structures according to this invention.

An explanation is now made about preferred embodiments of this invention with reference to the accompanying drawings. In FIG. 1 numeral 1 denotes a reinforcing member civil and architectural structures according to this invention. This reinforcing member 1 for civil and architectural structures uses eight pieces of fiber bundles 2. Each of the bundles 2 is formed by mixing a plurality of reinforcing fibers having a large tensile strength of, e.g., 100 kg/mm$^2$ or more and a plurality of thermoplastic fibers and then laying them together in the longitudinal direction. These fiber bundles 2 are braided together as shown in FIG. 1 to obtain the reinforcing member 1. As the above-described reinforcing fibers, the following can be used either singly or in combination, namely, for example, inorganic fibers such as carbon fibers, glass fibers, ceramic fibers or the like, and organic fibers such as aromatic polyamide fibers, polyamide fibers, or the like. As the above-described thermoplastic fibers, those fibers which have thermoplasticity at a relatively low temperature which is slightly above 200° C., such as nylon, polyester, polyethylene, or the like can be used. Considering the heat-resisting temperatures of the reinforcing fibers, those thermoplastic fibers which become thermoplastic at a lower temperature than the heat-resisting temperatures are selected. Preferably, such fibers as will become thermoplastic at a temperature which is lower by 100° C. or more than the heat-resisting temperatures of the reinforcing fibers are selected as the thermoplastic fibers.

In more detail, carbon fibers, glass fibers, ceramic fibers and polyamide fibers do not normally melt until above about 400° C. Therefore, when these fibers are used as the reinforcing fibers, any one of nylon which becomes thermoplastic at about 200° C., polyester which becomes thermoplastic at about 230° C. and polyethylene which becomes thermoplastic at about 110° C. may be mixed with the reinforcing fibers as the thermoplastic fibers.

Figure 2:
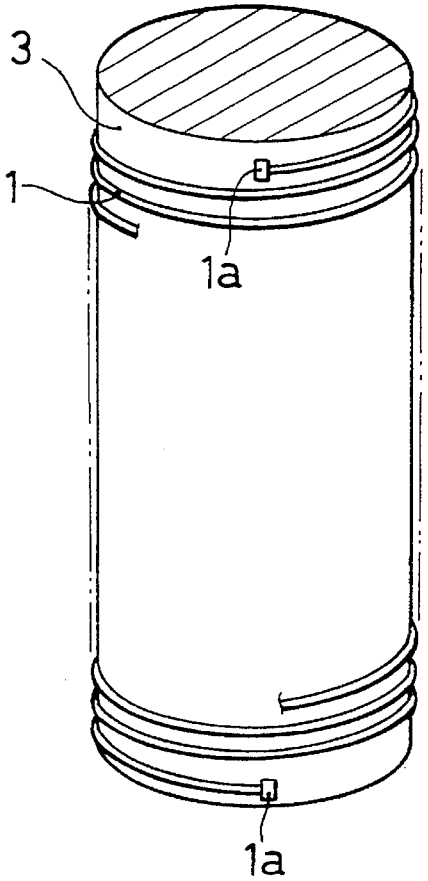
FIG. 2 is a perspective view showing the condition in which the reinforcing member of this invention is used.
Figure 3:
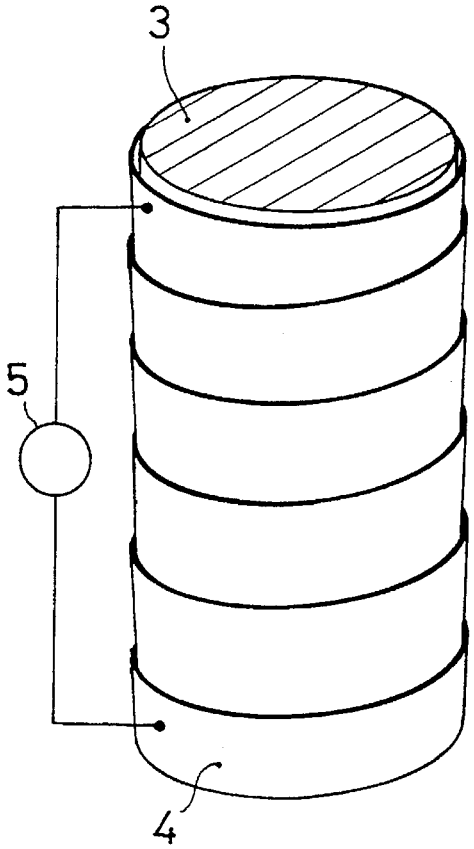
FIG. 3 is a perspective view showing the condition in which the reinforcing member of this invention is used.
Figure 4:
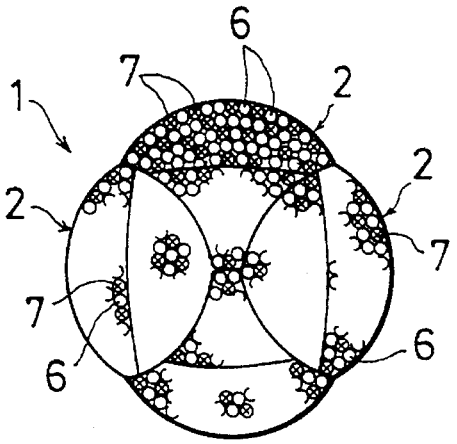
FIG. 4 is a schematic diagram showing the first embodiment of the reinforcing member of this invention.
Figure 5:
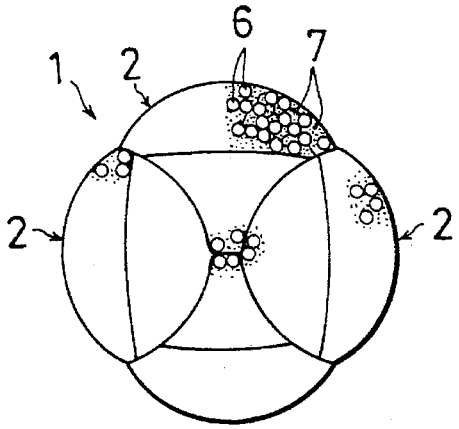
FIG. 5 is a schematic diagram showing the condition in which the reinforcing member of the first embodiment of this invention is used.

The reinforcing member 1 having the above-described constitution or construction is relatively rich in flexibility. When a column 3, for example, shown in FIG. 2 is reinforced, the reinforcing member 1 is wound around the column 3 at an appropriate pitch while giving it a tension, and both ends 1*a*, 1*a* thereof are fixed to the column with a suitable means. A heating device 4 comprising a belt-like heater such, for example, as shown in FIG. 3 is wound on an external surface of the reinforcing member 1. When the heating device 4 is charged with electric power from an electric power source 5 so that the thermoplastic fibers in the reinforcing member 1 are heated to a temperature at which the thermoplastic fibers become thermoplastic, the following change will occur. Namely, a condition in which the reinforcing fibers 6 and the thermoplastic fibers 7 are simply in contact with each other as schematically shown in FIG. 4 is changed to a condition in which the reinforcing fibers 6 around the thermoplastic fibers become adhered or bonded to each other as shown in FIG. 5 due to the thermoplastic characteristics of the thermoplastic fibers. When the electric power supply to the heating device 4 is stopped when the above-described condition has been attained, the thermoplastic fibers 7 are cooled and hardened while keeping the reinforcing fibers adhered or bonded therearound. As a result, the thermoplastic fibers 7 are provided with rigidity and, therefore, the reinforcing member 1 will no longer be easily displaced or removed off the position where it is wound around the column 3. Needless to say, it is possible to use as the heating device 4 a known heating means such as an infrared lamp or the like, in place of the belt-like heater.

The temperature at which the heating device 4 heats the thermoplastic fibers is controlled within a range in which the reinforcing fibers are not softened. If the temperature is controlled to a range which is within the above-described temperature and which yet melts the thermoplastic fibers, the molten resin of the thermoplastic fibers is widely spread among the reinforcing fibers, resulting in a favorable increase in the adhering or bonding characteristics of the reinforcing fibers.

Figure 6:
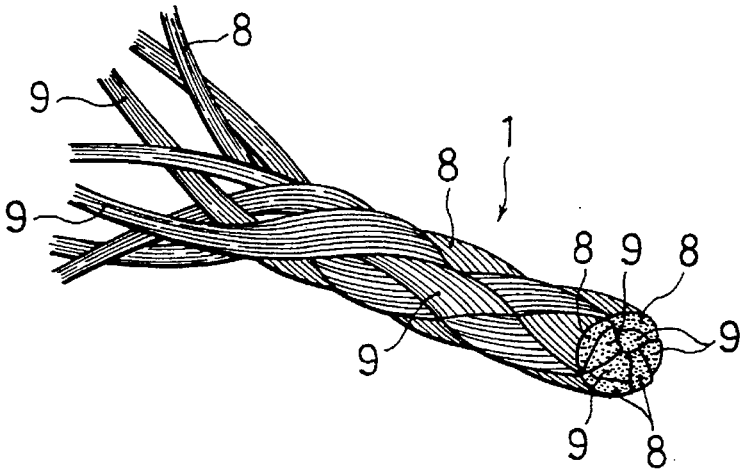
FIG. 6 is a perspective view of a second embodiment of the reinforcing member of this invention.

A second embodiment of this invention as shown in FIG. 6 is a reinforcing member 1 which is a braided arrangement of fiber bundles 8 of the reinforcing fibers and the fiber bundles 9 of the thermoplastic fibers. The reinforcing member of this arrangement can also be used in a similar manner as the above-described first embodiment.

In more detail, the fiber bundles 8 of the reinforcing fibers were made by aromatic polyamide fibers, and the fiber bundles 9 of the thermoplastic fibers were made by polyethylene. Four pieces each of these fiber bundles 8, 9 were arranged into a braided fiber body having a mixing ratio by weight of about 1:1, thereby obtaining the reinforcing member 1. Each of the fiber bundles 8, 9 had a size of 300000 denier. The reinforcing member 1 had a diameter of 8 mm and was able to be bent into a circle having a radius of 10 mm. This reinforcing member 1 was wound around a test piece concrete column which had a diameter of 280 mm and a length of 800 mm at a pitch of 100 mm and both ends thereof were fixed to the concrete column. The reinforcing member 1 was then sequentially heated from one end thereof at 200° C. The thermoplastic fibers were impregnated, through melting, into the spaces among the reinforcing fibers. With the hardening of the molten thermoplastic fibers, the reinforcing fibers were also hardened to have a rigidity while they were maintained in a predetermined wound position. This test piece concrete column is ordinarily expected to rupture under a load of 7 tons, but was able to be subjected to a load of up to 12 tons, where it ruptured. Since the reinforcing member 1 has a good flexibility before it is hardened, it can be used for reinforcing civil and architectural structures of concrete make which has a radius above the bending radius of the reinforcing member.

Figure 7:
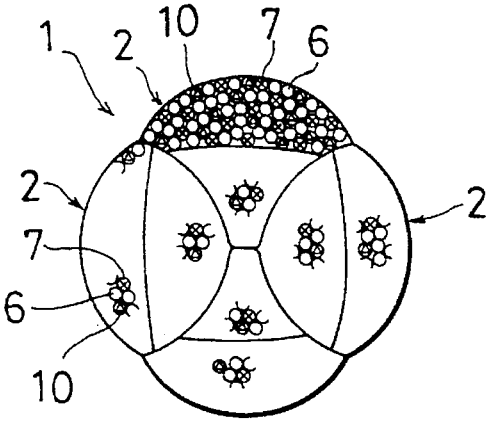
FIG. 7 is a perspective view of a third embodiment of the reinforcing member of this invention.

A third embodiment of this invention is schematically shown in FIG. 7. The reinforcing member 1 is formed by further mixing an electrically conductive heat-generating wiring material 10 made of one or a plurality of electric resistance heating members such as a carbon fiber, Nichrome wire or the like into the fiber bundles 2 of the reinforcing fibers 6 and the thermoplastic fibers 7 that are shown in FIG. 4. These fiber bundles 2 are arranged into a braided fiber body as shown in FIG. 1 to obtain the reinforcing member 1. This reinforcing member 1 is similarly used by winding around a structure as shown in FIG. 2. When the electrically conductive heat-generating wiring material 10 is heated through electric supply from a non-illustrated electric power source, the thermoplastic fibers 7 become either thermoplastic or molten to thereby adhesively combine or bond the surrounding reinforcing fibers 6, and are hardened. In this embodiment, the heating device 4 is not required during the reinforcing work as in the above-described embodiments, resulting in a simpler or easier reinforcing work. The heat-generating temperature of the electrically conductive heat-generating wiring material 10 can be controlled by the amount of electric power to be supplied thereto. Carbon fibers are normally heated to a temperature of 100°–250° C.

Figure 8:
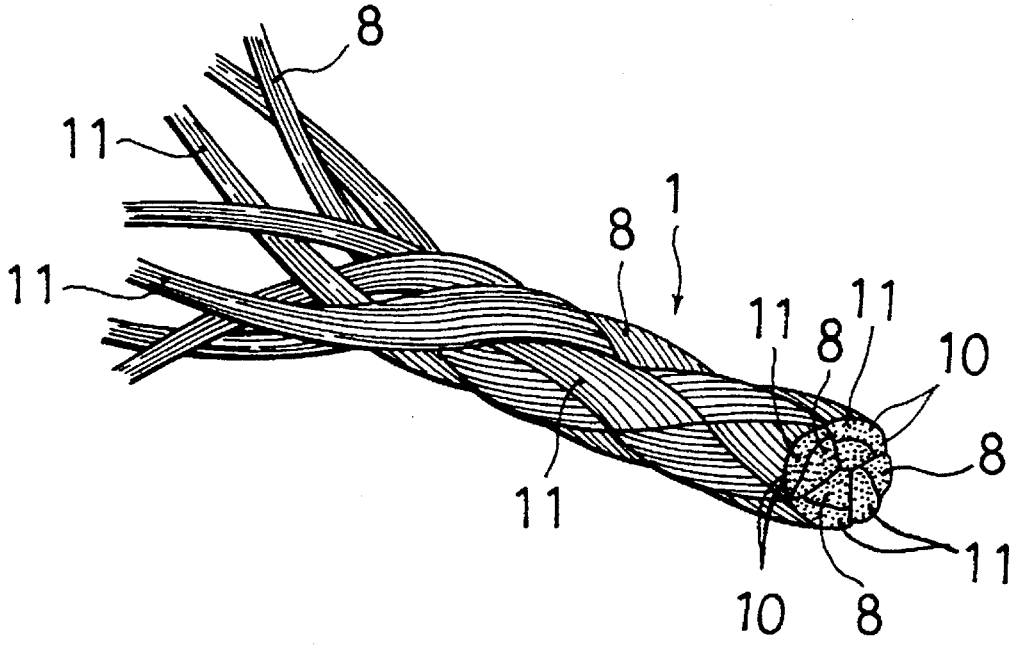
FIG. 8 is a perspective view of a fourth embodiment of the reinforcing member of this invention.

As shown in a fourth embodiment in FIG. 8, it is also possible to mix the electrically conductive heat-generating wiring material 10 with thermoplastic fibers to obtain fiber bundles 11. These fiber bundles 11 can thereafter be formed into a braided fiber body by arranging them with fiber bundles 8 of reinforcing fibers alone to obtain the reinforcing member 1.

Figure 9:
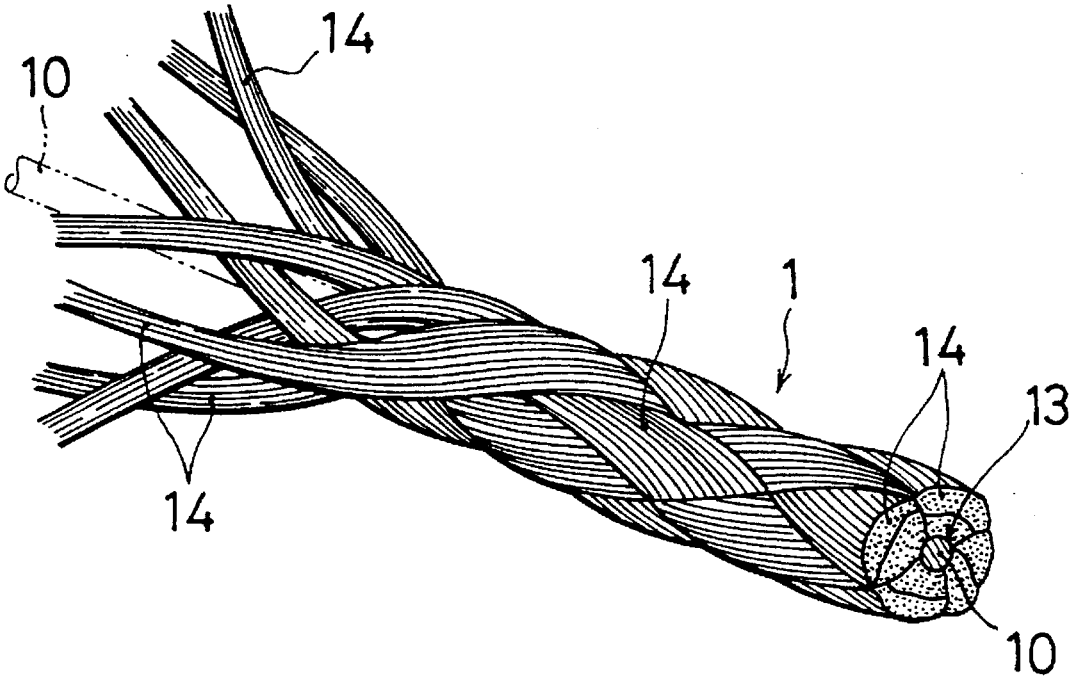
FIG. 9 is a perspective view of a fifth embodiment of the reinforcing member of this invention.

When several sets of fiber bundles are arranged into a braid, it is possible to arrange them while leaving a hollow portion in the center thereof. In this case, as in a fifth embodiment shown in FIG. 9, it is possible to insert one or a plurality of electrically conductive heat-generating wiring material 10 into the hollow portion 13. In this embodiment, as the fiber bundles 14, either a mixture of the reinforcing fibers and the thermoplastic fibers or separate bundles of the reinforcing fibers and the thermoplastic fibers, respectively, are used. In this fifth embodiment and in the above-described fourth embodiment, the reinforcing fibers can also be adhesively combined or bonded through the electric power supply to the electrically conductive heat-generating wiring material. Therefore, an extra heating device is not required.

The diameters of the reinforcing fibers used in these embodiments are 6–10 μm and the diameters of the thermoplastic fibers are 6–10 μm. In the first embodiment shown in FIG. 1, the reinforcing fibers and the thermoplastic fibers were made to be equal in number with a fineness of 6000 denier. They were then bundled to make fiber bundles and 8 pieces of the fiber bundles were arranged into a braided fiber body of about 8 mm in diameter.

According to this invention, as described hereinabove, since the braided fiber body of the reinforcing member is made up of a mixture of the reinforcing fibers and the thermoplastic fibers which are mixed into the reinforcing fibers, the braided fiber body can be easily wound around the portion to be repaired in the structures. Further, the thermoplastic fibers, after the winding work, can be made into a thermoplastic condition by heating to combine or bond the reinforcing fibers together. It is possible to provide the reinforcing fibers with rigidity by subsequent hardening to keep it in a fixed condition in a predetermined position. Consequently, the reinforcing work becomes easy. In addition, since the reinforcing member is lighter than the reinforcing bars and is free from corrosion, the coating for corrosion resistance becomes needless. A further increase in weight of the reinforcing member at a later stage is therefore prevented, and the repeated repair will not be required.

Description has hereinabove been made about a round braid, but a flat braid can also be used as well.

It is readily apparent that the above-described reinforcing member for civil and architectural structures has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A reinforced civil or architectural structure which sustains a load, comprising reinforcing fibers bonded together by thermoplastic fibers which have been melted, thereby forming a solid reinforcing member, said solid reinforcing member being formed on an existing civil or architectural structure from a braided fiber body wound on the civil or architectural structure, said braided fiber body being made up of a mixture of reinforcing fibers and thermoplastic fibers provided in bundles, the thermoplastic fibers being meltable at a temperature which is lower by 100° C. or more than a temperature at which said reinforcing fibers are meltable, said reinforcing fibers being bonded together by said thermoplastic fibers after melting said thermoplastic fibers.

2. A reinforcing member for civil and architectural structures according to claim 1, where said thermoplastic fibers are mixed into each bundle of said reinforcing fibers.

3. A reinforcing member for civil and architectural structures according to claim 2, wherein an electrically conductive heat-generating wiring material is mixed into each bundle.

4. A reinforcing member for civil and architectural structures according to claim 2, wherein said braided fiber body is arranged into a hollow braid having a hollow portion in the center thereof and wherein an electrically conductive heat-generating wiring material is provided within said hollow portion.

5. A reinforcing member for civil and architectural structures according to claim 1, wherein said mixture is formed into a braided fiber body by braiding bundles of reinforcing fibers and bundles of thermoplastic fibers.

6. A reinforcing member for civil and architectural structures according to claim 5, wherein said braided fiber body comprises (i) bundles of reinforcing fibers and (ii) bundles of thermoplastic fibers mixed with an electrically conductive heat-generating wiring material.

7. A reinforcing member for civil and architectural structures according to claim 5, wherein said braided fiber body is arranged into a hollow braid having a hollow portion in the center thereof and wherein an electrically conductive heat-generating wiring material is provided within said hollow portion.

8. A reinforcing member for civil and architectural structures according to claim 1, wherein said braided fiber body is arranged into a hollow braid having a hollow portion in the center thereof and wherein an electrically conductive heat-generating wiring material is provided within said hollow portion.

9. A reinforcing member for civil and architectural structures according to claim 1, wherein said reinforcing fibers are selected from one or more of inorganic fibers and organic fibers.

10. A reinforcing member for civil and architectural structures according to claim 9, wherein said inorganic fibers are selected from the group consisting of carbon fibers, glass fibers and ceramic fibers and said organic fibers are, selected from the group consisting of aromatic polyamide fibers and polyamide fibers.

11. A reinforcing member for civil and architectural structures according to claim 1, wherein said thermoplastic fibers are selected from the group consisting of nylon, polyester and polyethylene.

12. A reinforcing member for civil and architectural structures according to claim 1, wherein the civil or architectural structure is a member selected from the group consisting of beams and columns of buildings, piers and chimneys.

13. A reinforcing member for civil and architectural structures according to claim 1, wherein the civil or architectural structure comprises concrete.

14. A reinforcing member for civil and architectural structures which sustain a load, consisting of a braided fiber body made up of a mixture of reinforcing fibers bonded together by thermoplastic fibers which have been melted, thereby forming a solid reinforcing member, said solid reinforcing member being formed on an existing civil architectural structure by winding the braided fiber body therearound, the thermoplastic fibers being meltable at a temperature which is lower by 100° C. or more than a temperature at which said reinforcing fibers are meltable, said reinforcing fibers being bonded together by said thermoplastic fibers after said thermoplastic fibers.

15. A reinforcing member for civil and architectural structures according to claim 14, wherein the civil or architectural structure is a member selected from the group consisting of beams and columns of buildings, piers and chimneys.

16. A reinforcing member for civil and architectural structures according to claim 14, wherein the civil or architectural structure comprises concrete.

17. A reinforced civil or architectural structure which sustains a load, comprising an existing civil or architectural structure and reinforcing fibers bonded together by thermoplastic fibers which been melted to form a solid reinforcing member, said solid reinforcing member being on the civil or architectural structure from a braided fiber body wound on the civil or structure, said braided fiber body being made up of a mixture of reinforcing fiber and thermoplastic fibers provided in bundles, the thermoplastic fibers being meltable at a temperature which is lower by 100° C. or more than a temperature at which said reinforcing fibers are meltable, said reinforcing fibers being bonded together by said thermoplastic fibers after melting said thermoplastic fibers.

* * * * *

UNITED STATES PATENT AND TRADEMARK OFFICE

CERTIFICATE OF CORRECTION

PATENT NO.: 5,580,642
DATED : December 3, 1996
INVENTOR(S): OKAMOTO et al.

It is certified that error appears in the above-identified patent and that said Letters Patent is hereby corrected as shown below:

Claim 2, col. 6, lines 18-19, "reinforcing member for civil and architectural structures" should read --reinforced civil or architectural structure--.

Claim 3, col. 6, lines 21-22, "reinforcing member for civil and architectural structures" should read --reinforced civil or architectural structure--.

Claim 4, col. 6, lines 25-26, "reinforcing member for civil and architectural structures" should read --reinforced civil or architectural structure--;

col. 6, line 30, after "portion" insert --before said braided fiber body is wound on the civil or architectural structure--.

Claim 5, col. 6, lines 31-32, "reinforcing member for civil and architectural structures" should read --reinforced civil or architectural structure--.

Claim 6, col. 6, lines 35-36, "reinforcing member for civil and architectural structures" should read --reinforced civil or architectural structure--.

Claim 7, col. 6, lines 40-41, "reinforcing member for civil and architectural structures" should read --reinforced civil or architectural structure--;

col. 6, line 45, after "portion" insert --before said braided fiber body is wound on the civil or architectural structure--.

UNITED STATES PATENT AND TRADEMARK OFFICE

CERTIFICATE OF CORRECTION

PATENT NO.: 5,580,642
DATED : December 3, 1996
INVENTOR(S): OKAMOTO et al.

It is certified that error appears in the above-identified patent and that said Letters Patent is hereby corrected as shown below:

Claim 8, col. 6, lines 46-47, "reinforcing member for civil and architectural structures" should read --reinforced civil or architectural structure--;

col. 6, line 50, after "portion" insert --before said braided fiber body is wound on the civil or architectural structure--.

Claim 9, col. 6, lines 52-53, "reinforcing member for civil and architectural structures" should read --reinforced civil or architectural structure--.

Claim 10, col. 6, lines 56-57, "reinforcing member for civil and architectural structures" should read --reinforced civil or architectural structure--;

Claim 11, col. 6, lines 62-63, "reinforcing member for civil and architectural structures" should read --reinforced civil or architectural structure--.

Claim 12, col. 6, lines 66-67, "reinforcing member for civil and architectural structures" should read --reinforced civil or architectural structure--.

Claim 13, col. 7, lines 4-5, "reinforcing member for civil and architectural structures" should read --reinforced civil or architectural structure--.

UNITED STATES PATENT AND TRADEMARK OFFICE

CERTIFICATE OF CORRECTION

PATENT NO.: 5,580,642
DATED : December 3, 1996
INVENTOR(S): OKAMOTO et al.

It is certified that error appears in the above-identified patent and that said Letters Patent is hereby corrected as shown below:

Claim 14, col. 7, lines 7-8, "reinforcing member for civil and architectural structures" should read --reinforced civil or architectural structure--.

line 8, after "load" insert --comprising a solid reinforcing member--;

line 12, after "civil" insert --or--;

line 18, after "after" insert --melting--.

Claim 15, col. 7, lines 19-20, "reinforcing member for civil and architectural structures" should read --reinforced civil or architectural structure--.

Claim 16 col. 8 lines 3-4, "reinforcing member for civil and architectural structures" should read --reinforced civil or architectural structure--.

UNITED STATES PATENT AND TRADEMARK OFFICE

CERTIFICATE OF CORRECTION

PATENT NO. : 5,580,642
DATED : December 3, 1996
INVENTOR(S) : OKAMOTO et al.

It is certified that error appears in the above-indentified patent and that said Letters Patent is hereby corrected as shown below:

Claim 17, col. 8, lines 9, after "which" insert --have--;

line 10, after "being" insert --formed--;

line 12, after "or" insert --architectural--.

Signed and Sealed this

Sixth Day of May, 1997

*Attest:*

Bruce Lehman

BRUCE LEHMAN

*Attesting Officer*

*Commissioner of Patents and Trademarks*